United States Patent [19]

Meyer et al.

[11] 4,443,250

[45] Apr. 17, 1984

[54] PROCESS OF PRODUCING SPONGE IRON BY A DIRECT REDUCTION OF IRON OXIDE-CONTAINING MATERIALS

[75] Inventors: Kurt Meyer; Lothar Reh, both of Frankfurt am Main; Martin Hirsch, Friedrichsdorf; Wolfram Schnabel, Idstein; Harry Serbent, Hanau, all of Fed. Rep. of Germany

[73] Assignee: Metallgesellschaft Aktiengesellschaft, Frankfurt am Main, Fed. Rep. of Germany

[21] Appl. No.: 417,958

[22] Filed: Sep. 14, 1982

[30] Foreign Application Priority Data

Mar. 20, 1982 [DE] Fed. Rep. of Germany ..... 3210232

[51] Int. Cl.[3] ..... C21B 13/08

[52] U.S. Cl. ..... 75/26; 75/34; 75/36; 75/91; 266/172; 266/173

[58] Field of Search ..... 75/26, 36, 33, 35, 34

[56] References Cited

FOREIGN PATENT DOCUMENTS 1365441 5/1963 France ..... 75/26

*Primary Examiner*—M. J. Andrews

*Attorney, Agent, or Firm*—Sprung, Horn, Kramer & Woods

[57] ABSTRACT

Fine-grained material which contains iron oxide is prereduced in a fluidized bed and is subsequently completely reduced in a rotary kiln. In order to avoid agglomeration and incrustation in the rotary kiln, the prereduction is carried out to effect a metallization of 50 to 80%.

11 Claims, 1 Drawing Figure

PROCESS OF PRODUCING SPONGE IRON BY A DIRECT REDUCTION OF IRON OXIDE-CONTAINING MATERIALS

BACKGROUND OF THE INVENTION

1. Field of the Invention

This invention relates to a process of producing sponge iron by a direct reduction of iron oxide-containing materials comprising a prereduction if a fluidized bed and a final reduction carried out below the melting point of the charge in a rotary kiln.

2. Description of Prior Art

In the dressing of relatively poor iron ores, fine-grained concentrates having a substantial proportion of particles smaller than 0.25 mm become increasingly available. These concentrates and fine-grained ores are less expensive than, e.g., pellets or lump ores.

On the other hand it is difficult to subject such fine-grained materials which contain iron oxide to a direct reduction in a rotary kiln because fine-grained material and particularly the very small particles contained therein in a high proportion tend to form agglomerates and crusts in the rotary kiln.

It is known from German Offenlegungsschrift No. 20 20 306 to charge a rotary kiln with fine-grained ores having a particle size of about 0.25 to 3 mm and with sulfur-binding materials having a particle size of about 0.2 to 2 mm, to drive the rotary kiln at a peripheral velocity of 2 to 20 meters per minute and to maintain in the reduction zone a temperature between 1000° C. and 1115° C. This practice imposes a lower limit regarding the particle size of the ore and requires the rotary kiln to be rotated at a higher speed as the fines content increases.

It is known from German Offenlegungsschrift No. 15 33 869 to effect the direct reduction with reducing gases in two stages in order to improve the utilization of the gases. One-half of the total combined oxygen contained in the ore is removed in the prereduction stage and the other half in the final reduction stage and a metallization of about 25 to 35% is effected by the prereduction. The prereduction may be effected by a countercurrent operation in a shaft furnace, a rotary kiln or a fluidized bed. The final reduction can also be effected in such equipment in a countercurrent cocurrent or transverse current operation. The use of rotary kilns and the processing of fine-grained ore involve the disadvantages described hereinbefore. Even if a fluidized bed is used for the prereduction, the disadvantages encountered in a succeeding rotary kiln cannot be avoided.

It is also known to carry out in a fluidized bed a prereduction resulting in a metallization of 50 to 80% and to subject a molten charge to the final reduction in an electric furnace (Offenlegungsschrifts Nos. 25 52 904 and 26 07 554, German Pat. No. 22 53 228). Expensive electric energy is consumed at a hihg rate for the final reduction. A metallization to a higher degree in the fluidized bed involves difficulties in the fluidized bed.

SUMMARY OF THE INVENTION

It is an object of the invention to produce highly metallized sponge iron from fine-grained materials in a rotary kiln, the operation of which is not disturbed by deposition or agglomeration.

This object is accomplished according to the invention in that fine-grained materials which contain iron oxide are prereduced in a fluidized bed to effect a metallization of 50 to 80% of their iron content, and in that the prereduced fine-grained material is completely reduced in a rotary kiln.

The metallization is the ratio of metallic iron to total in percent $$(Fe_{met}/Fe_{tot})\times 100$$

Suitable fluidized beds include low-expansion fluidized beds having a defined surface as well as more highly expanded fluidized beds which are operated at a velocity in excess of the terminal velocity of the individual particles, such as circulating fluidized beds. The prereduced material is preferably charged to the rotary kiln in a hot state so that heating energy is saved and the rotary kiln, which has poor heat transfer properties, is relieved from the reheating work. But the prereduced material may alternatively be charged to the rotary kiln in a cold state. The reducing agents used in the rotary kiln may consist of coals, gas, oil or combinations of said reducing agents. The rotary kiln may be used for a countercurrent or cocurrent operation and may be provided with shell pipes, shell burners and/or nozzle blocks. Desulfurizing agents may be added, if desired. Any surplus of solid carbon in the discharged matter can be separated and recycled to the rotary kiln.

Surprisingly it has been found that the material which has been prereduced in accordance with the invention can easily be completely reduced in the rotary kiln although the particle size of the material has not been increased substantially in the fluidized bed. There is no need for special measures, such as a high peripheral velocity of the rotary kilns or the use of a lower limit for the particle size.

According to a preferred further feature, the prereduction in the fluidized bed is effected to a metallization of 60 to 70%. A metallization to that degree results in particularly favorable conditions in the fluidized bed and in the rotary kiln.

According to a further preferred feature, the final reduction in the rotary kiln is effected by means of solid carbonaceous reducing agents. Solid reducing agents loosen the charge in the rotary kiln so that the tendency to agglomerate and form crusts is further reduced and the reduction is influenced in a favorable manner.

According to a further preferred feature, at least a major part of the solid carbonaceous reducing agent for the final reduction is charged into the fluidized bed and together with the prereduced material is charged in a hot state to the rotary kiln. As a result, the coal is also charged to the rotary kiln in a preheated state and caking coals which involve difficulties, can also be used whereas their direct charging to the rotary kiln would result in troubles in operation.

According to a further preferred feature, the particle size of the fine-grained material which contains iron oxide is not in excess of about 2 millimeters. This results in advantageous operating conditions for the fluidized bed.

According to a further preferred feature, a fine-grained solid desulfurizing agent is fed to the rotary kiln. The desulfurizing agent has a particle size below 3 millimeters. Conventional desulfurizing agents, such as limestone or dolomite, are used. In this manner a sponge iron having a low sulfur content can be obtained.

According to a further preferred feature, the matter discharged from the rotary kiln is cooled and is then separated into sponge iron, surplus fuel and desulfurizing agent. In that manner the desulfurizing agent, which contains the sulfur, can easily be removed from the process and the surplus carbon can be separated also.

DETAILED DESCRIPTION OF THE INVENTION

Figure 1:
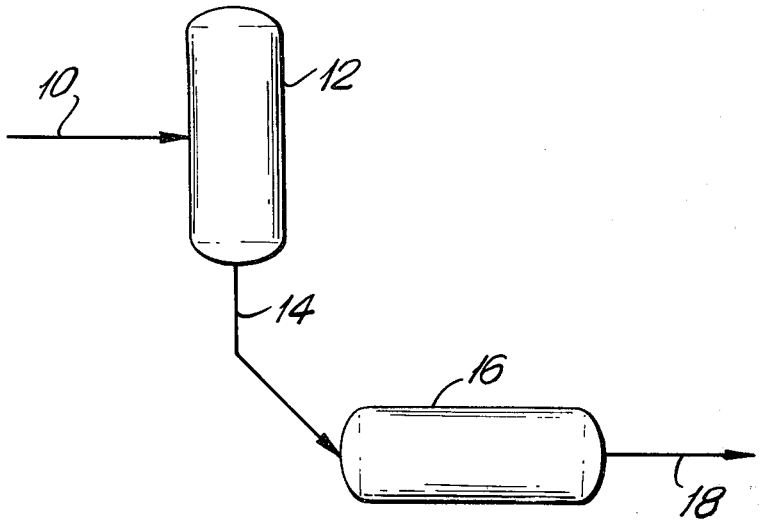
FIG. 1 is a schematic flow diagram of a process according to the present invention.

With reference to FIG. 1, there is shown a feed stream 10 containing fine grained materials which is fed into a fluidized bed 12 to effect metallization of 50 to 80% of the iron content of the feed 10. Stream 14 exits the fluidized bed 12 and is directed to rotary kiln 16 to produce a completely reduced highly metallized sponge iron stream 18.

Generally speaking, the prereduction in the fluidized bed zone and the final reduction in the rotary kiln is carried out at at temperature between 900° C. and 1150° C. The preferred temperature range using gas-rich bituminous and subbituminous coals is 930° C. to 1060° C. and for coals having a low gas content, for instance anthracite, 1000° C. to 1120° C. The prereduction is carried out at about atmospheric pressure although elevated pressures can also be employed. The fluidized bed zone is maintained under such conditions such that metallization of at last 50% of the iron content is effected. The charge to the fluidized bed zone generally has a particle size of up to 3 mm, especially up to 2 mm, with considerable amounts below 0.25 mm and amounts below 0.1 mm.

Following the prereduction to the extent of metallization of at least 50%, the charge is introduced to a rotary kiln into which is introduced, either with the prereduced iron oxide material or from a separate source, a reducing material, especially a solid carbonaceous reducing material. The final reduction in the rotary kiln is carried out until the fine-grained material is completely reduced to the desired metallization. By the term "completely reduced" is meant a metallization of 85% to 95%, preferably 89% to 93%. To obtain this metallization it is generally necessary to employ a stoichiometric excess of reducing agent. If coal is used as reducing agent the surplus carbon in the discharge material of the rotary kiln is adjusted to a weight ratio of 0.03 to 0.05 $C_{fixed}$/Fe for bituminous and subbituminous coals and of 0.05 to 0.1 $C_{fixed}$/Fe for low gas coals.

The prereduced material fed into the rotary kiln has almost the same grain size than the iron oxide containing material fed to the fluidized bed zone. Only the grain size of the very fine particles below 0, 1 mm is increased.

When desulfurizing agents are employed, desulfurizing agents are generally introduced into the rotary kiln in an amount of between 1 and 5 percent by weight based upon the weight of iron/iron oxide containing materials introduced into the rotary kiln.

EXAMPLES

The invention will be explained more fully with reference to examples.

Hematitic iron ore containing 67% Fe was used. It had the following particle size distribution:

100%: below 1.5 mm
80%: below 0.5 mm
35%: below 0.25 mm
10%: below 0.1 mm

EXAMPLE 1 (Prior Art)

The iron ore together with lignite (coal) in an amount corresponding to 0.5 kg $C_{fix}$ per kg Fe was charged into an electrically heated rotary kiln. The kiln was heated up to 980° C. during four hours, and thereafter, the kiln was held at that temperature and samples of material were taken from the kiln in intervals of one hour with a sample spoon scavenged with $N_2$. It was found that the material sintered when a reduction (calculated as removal of $O_2$) of about 50% had been reached, which corresponded to a metallization of about 25%. This showed that a further reduction could not be effected.

EXAMPLE 2 (Prior Art)

The ore-coal mixture used in Example 1 was reduced in a fluidized bed also at 980° C. to a reduction of 50%, corresponding to a metallization of 25%. The prereduced material was subsequently charged to an electrically heated rotary kiln. At a temperature of 980° C., a sintering of the contents of the kiln was observed after a short time when the metallization had increased only slightly.

EXAMPLE 3

The ore-coal mixture used in Example 1 was reduced in a fluidized bed also at 980° C. but to a reduction of 75% according to a metallization of 63% before it was charged to the rotary kiln and treated therein as described in Example 2. In this way a metallization up to 92% was achieved without a sintering in the kiln.

The advantages afforded by the invention reside in that fine-grained materials can be reduced easily and economically to produce sponge iron. Only low-cost primary energy is required in both stages, particularly in the final reduction stage, and the rotary kiln is relieved from preheating work.

What is claimed is:

1. In a process of producing sponge iron by a direct reduction of iron oxide-containing materials including prereducing a charge in a fluidized bed and final reducing the charge below the melting point of the charge in a rotary kiln, the improvement which comprises prereducing fine-grained materials which contain iron oxide and have an iron content in a fluidized bed to achieve a metallization of 50 to 80% of the iron content of the iron oxide of the fine grained materials and, thereafter, completely reducing the prereduced fine-grained materials in a rotary kiln.

2. A process according to claim 1, wherein the prereduction in the fluidized bed is effected to a metallization of 60 to 70%.

3. A process according to claim 1 or 2, characterized in that the final reduction in the rotary kiln is effected by means of solid carbonaceous reducing agents.

4. A process according to claim 3, wherein at least a major part of the solid carbonaceous reducing agent for the final reduction is charged into the fluidized bed and together with the prereduced material is charged in a hot state to the rotary kiln.

5. A process according to claim 1, wherein the particle size of the fine-grained material which contains iron oxide is not in excess of about 2 millimeters.

6. A process according to claim 1, wherein the particle size of the fine-grained material containing iron oxide is less than 2 millimeters.

7. A process according to claim 1, wherein a fine-grained solid desulfurizing agent is fed to the rotary kiln.

8. A process according to claim 7, wherein said desulfurizing agent has a particle size of less than 3 millimeters.

9. A process according to claim 7 wherein the matter discharged from the rotary kiln is cooled and is then separated into sponge iron, surplus fuel and desulfurizing agent.

10. A process according to claim 3, wherein said reducing agent is coal.

11. A process according to claim 7, wherein the amount of said desulfurizing agent is between about 1 and about 5 percent by weight based on the weight of the charge to the rotary kiln.

* * * * *